United States Patent [19]

Fujimori et al.

[11] Patent Number: 4,806,900

[45] Date of Patent: Feb. 21, 1989

[54] THERMISTOR AND METHOD FOR PRODUCING THE SAME

[76] Inventors: Naoji Fujimori; Takahiro Imai, both of c/o Itami Works of Sumitomo Electric Industries, Ltd., 1-1, Koyakita 1-chome, Itami-shi, Hyogo-ken, Japan

[21] Appl. No.: 101,243

[22] Filed: Sep. 25, 1987

[30] Foreign Application Priority Data

Sep. 26, 1986 [JP] Japan ..... 61-226212

[51] Int. Cl.[4] ..... H01C 7/10

[52] U.S. Cl. ..... 338/22 R; 338/22 SD

[58] Field of Search ..... 338/22 R, 225, 25

[56] References Cited

U.S. PATENT DOCUMENTS

| | | | |
|---|---|---|---|
| 3,435,399 | 3/1969 | Gielisse et al. | 338/22 R |
| 3,735,321 | 5/1973 | Bovenkerk | 338/22 SD |
| 4,276,535 | 6/1981 | Mitsuyu et al. | 338/22 R |
| 4,359,372 | 11/1982 | Nagai et al. | 338/22 R X |
| 4,467,309 | 8/1984 | Matsushita et al. | 338/25 X |

*Primary Examiner*—C. L. Albritton

*Attorney, Agent, or Firm*—Cushman, Darby & Cushman

[57] ABSTRACT

A thermistor comprising a substrate and a heat sensitive element consisting of a semiconductive thin film diamond, which can measure high temperatures up to 800° C. or higher.

5 Claims, 4 Drawing Sheets

THERMISTOR AND METHOD FOR PRODUCING THE SAME

BACKGROUND OF THE INVENTION

1. Field of the Invention

The present invention relates to a thermistor and a method for producing the same. More particularly, it relates to a thermistor comprising a heat sensitive element consisting of thin film diamond which can measure high temperatures and a method for producing such thermistor.

2. Description of the Prior Art

A thermistor is widely used as a temperature measuring sensor in a variety of apparatuses and instruments. The thermistor has many advantages such that it has a larger temperature coefficient than a thermocouple, that it can be used in a voltage-current range in which a temperature is relatively easily measured, and that it does not require zero adjustment. As a heat sensitive element material for the thermistor, used are glass, Mn-Ni base oxides, SiC, $BaTiO_3$ and the like.

The currently used thermistors are roughly divided into two kinds according to their characteristics. In one of them, the resistance change is proportional to temperature change, and in the other of them, the resistance abruptly changes at or around a certain specific temperature.

The former type thermistor finds many industrial applications for temperature control since it has larger resistance change against temperature change than other temperature measuring methods such as the thermocouple. The conventional thermistor can measure a temperature as high as 300° C. when SiC is used as a heat sensitive element. However, it cannot measure a temperature higher than 300° C. and it has been desired to provide a thermistor which can measure a temperature from room temperature to about 500° C. or higher.

Diamond is not only hard but also thermally and chemically stable and does not corrode in a corrosive atmosphere up to 800° C. Further, since it has the largest thermal conductivity (20 W/cm.K) among all materials and comparatively small specific heat, it has a high response rate and a wide measurable temperature range up to high temperature.

Although pure diamond is a good electrical insulant up to about 500° C., when the diamond contains an impurity such as boron, it shows semiconducting property at room temperature.

Natural diamond rarely contains such semiconductive diamond, which is named as a "IIb" type, and it was proposed to produce a thermistor by using such impurity-doped natural diamond (cf. G. B. Rogers and F. A. Raal, Rev. Sci. Instrum., 31 (1960) 663).

However, since the natural occurring semiconductive diamond is very rare and has largely fluctuating characteristics, it cannot be practically and industrially used.

Nowadays, diamond can be artificially synthesized under ultra high pressure such as 40,000 atm. or higher. According to the synthesis technique of diamond, semiconductive diamond containing an impurity such as boron and aluminum can be synthesized and used in the production of the thermistor (cf. U.S. Pat. No. 3,435,399 and L. F. Vereshchagin et al, Sov. Phys. Semicond.).

The synthesized semiconductive diamond can measure a temperature up to 800° C. with good linearity and reproducibly synthesized. However, since it is synthesized by means of an ultra high pressure generating apparatus, it is expansive. The diamond crystal is separated out from a metal solvent, it is difficult to homogeneously distribute the impurity throughout the diamond crystal. In addition, shapes of each synthesized diamond crystals are different and should be processed to form a suitable shape for the thermistor. Since the diamond is the hardest material in the world, its processing is difficult and expensive, which increases a production cost of the thermistor.

SUMMARY OF THE INVENTION

One object of the present invention is to provide a thermistor utilizing semiconductive diamond as a heat sensitive element which can measure a temperature up to about 500° C. or higher with good response.

Another object of the present invention is to provide a method for economically and reproducibly producing a thermistor utilizing semiconductive diamond as a heat sensitive element.

These and other objects of the present invention are achieved by a thermistor comprising a substrate and a heat sensitive element consisting of a semiconductive thin film diamond.

DETAILED DESCRIPTION OF THE INVENTION

Figure 1:
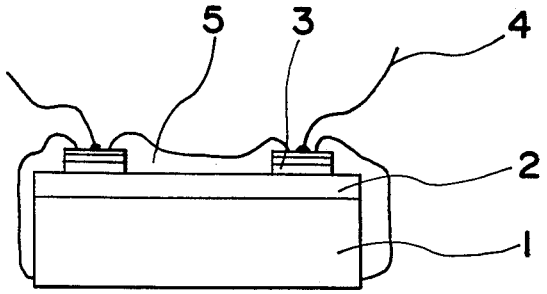
FIG. 1 is a cross section of one embodiment of a thermistor according to the present invention.

The diamond is stable under pressure of several ten thousand atm. or higher, and the diamond is artificially synthesized under such ultra high pressure conditions under which the diamond is stable.

Recently, the diamond can be synthesized in a vapor phase under conditions under which it is not stable such as under atmospheric pressure or lower according to a non-equilibrium process (cf. U.S. Pat. No. 4,434,188).

Since a hydrocarbon such as methane is used as a carbon source in the vapor phase synthesis of the diamond, the impurity element can be doped in the diamond by supplying a suitable impurity supplying material in a gas state together with the hydrocarbon. Therefore, according to the vapor phase synthesis of the diamond, various impurities which cannot be doped in the diamond by the ultra high pressure method can be doped into the diamond homogeneously with good control.

The vapor phase synthesis of the diamond can be carried out by various methods. For example, the raw material gas is activated by discharge generated by direct or alternating electrical field or by heating a thermoelectric emissive material. Alternatively, the raw material can be decomposed and excited by high energy light such as laser and UV light. In other method, a surface of a substrate on which the diamond thin layer is formed is bombarded by ions. In these methods, the raw material is preferably a hydrocarbon of the formula:

$C_mH_n$ or $C_mH_nO_l$ wherein m is an integer of 1 to 8, n an integer which varies with the number of unsaturated bonds in the compound, and l is an integer of 1 to 6. For instance, by a plasma CVD (chemical vapor deposition) method, when high frequency electrodeless discharge of 13.56 KHz is applied to a gaseous mixture of methane and hydrogen in a molar ratio of 1:150, the diamond crystal can be grown on a substrate of 20 mm×20 mm at a rate of 1.0 μm/hr. The thickness of the thin film diamond can be from 0.05 to 100 μm.

When a gaseous compound comprising a suitable impurity element is added to the raw material, the impurity can be doped in the synthesized diamond. A doped amount of the impurity is adjusted by selecting a ratio of the raw material and the compound containing the impurity element. According to this manner, any element that is not present stably in the diamond under ultra high pressure (e.g. phosphorus, arsenic, chlorine, sulfur, selenium, etc.) can be doped in the diamond. Accordingly, in the present invention, the dopant element can be selected from a wide group of the elements such as boron, aluminum, phosphorus, arsenic, antimony, silicon, lithium, sulfur, selenium, chlorine and nitrogen.

An impurity element compound having a high vapor pressure such as nitrogen and chlorine can be used as such. The impurity element having a low vapor pressure can be used in the form of a hydride, an organometallic compound, a chloride, an alkoxide and the like.

Although the diamond is the hardest material as described in the above, the diamond can be formed according to the gaseous synthesis in a thin film form on a substrate having an arbitrary shape, and any shape of the thermistor can be designed and produced. For example, the thermistor is generally in the form of a square, rectangular or round plate because of facility of production. Particularly when a cross section or a whole volume of the thermistor is desired to be small, it may be in the form of a prism, a rod or a wire.

Since the thin film diamond is easily trimmed by, for example, laser beam discharge, resistance of each thermistor can be precisely adjusted. Thereby, a yield of the thermistors with high resistance precision is increased.

Since the resistance characteristics of the thermistor vary with the kind of the impurity element, it is possible to select an impurity element most suitable for the intended application of the thermistor.

For example, the semiconductive thin layer diamond containing boron as the dopant has resistance which linearly changes in a wide temperature range from room temperature to about 800° C., and therefore is suitable for the thermistor to be used in a wide temperature range.

The semiconductive thin layer diamond containing nitrogen, phosphorus, selenium or chlorine as the dopant has larger resistance but a larger rate of resistance change than that containing boron, and the thermistor comprising such thin layer diamond has high sensitivity at higher temperatures.

According to the present invention, since the resistance can be measured across the thickness of the thin layer diamond even when the thickness is 5 μm or less, the thin layer diamond having resistivity of $10^7$ ohm.cm or higher can be used as the heat sensitive element of the thermistor. Because of this fact, according to the present invention, even non-doped thin layer diamond or nitrogen-doped thin layer diamond may be used as a heat sensitive element of the thermistor to be used at a temperature higher than 300° C.

As a substrate on which the thin layer diamond is formed, a single crystal diamond and other material are contemplated.

The single crystal diamond is most suitable as the substrate for the thermistor comprising the thin layer diamond as the heat sensitive element, since it has small specific heat (0.5 J/g.K) and large thermal conductivity (20 W/cm.K). Further, since a smooth thin layer of diamond is grown on the single crystal diamond, a very thin diamond layer can be formed on the crystal substrate diamond with good control. The single crystal diamond with homogeneous quality can be produced by the ultra high pressure method, although it is expensive in comparison to other materials.

The substrate materials other than the single crystal diamond include metals, semiconductive materials and their compounds. For example, metals such as boron, aluminum, silicon, titanium, vanadium, zirconium, niobium, molybdenum, hafnium, tantalum and tungsten, and their oxides, carbides, nitrides and carbonitrides are suitable. Among them, silicon, molybdenum, tantalum and tungsten are preferred since they are easily available and have larger thermal conductivity.

Since the thin layer diamond grown on the single crystal diamond is extremely smooth, a thickness of at least 0.05 μm is sufficient for practical use. When the thin layer polycrystal diamond is grown on other substrate, pin holes tend to be formed. Therefore, the thin layer diamond preferably has a thickness of not smaller than 0.3 μm.

An ohmic electrode to be attached to the thermistor is preferably made of titanium, vanadium, zirconium, niobium, molybdenum, hafnium, tantalum and tungsten as well as their carbides, nitrides and carbonitrides since they have good heat resistant and adhesivity with the diamond. Among them, titanium and tantalum are more preferable since then have better adhesivity with the diamond.

Although the diamond is stable in the air up to 600° C., it is graphitized at a temperature higher than 600° C. When the surface of the diamond is covered with a protective layer which comprises an insulating oxide such as silicon oxide, aluminum oxide and boron oxide, the thermistor can stably measure temperatures higher than 600° C. or higher, particularly higher than 800° C.

The present invention will be illustrated by following examples.

EXAMPLE 1

Ib type diamond synthesized under ultra high pressure was processed along its (100) plane to produce a small chip of 2 mm×1 mm×0.3 mm. On this chip, a thin layer of semiconductive diamond was epitaxially grown and its resistance-temperature characteristics were measured.

The thin layer diamond was grown by a microwave plasma CVD method disclosed in U.S. Pat. No. 4,434,188, the disclosure of which is hereby incorporated by reference.

A mixture of methane and hydrogen in a volume ratio of 1:100 was charged in a quartz reactor tube. With keeping the pressure at 4 KPa, microwave of 2.45 GHz and 450 W was irradiated to the reactor to generate plasma in the reactor.

As the impurity element, boron, aluminum, sulphur, phosphorus, arsenic, chlorine or antimony was doped by supplying each of the compounds in Table 1 in a concentration shown in Table 1. The growth time is also shown in Table 1.

TABLE 1

| Impurity element | Compound | Concentration (ppm)*1 | Growth time (hrs.) |
|---|---|---|---|
| B | $B_2H_6$ | 100 | 1.0 |
| Al | $(CH_3)_3Al$ | 400 | 1.0 |
| S | $H_2S$ | 500 | 1.0 |
| P | $PH_3$ | 500 | 1.0 |
| As | $AsH_3$ | 1,000 | 2.0 |
| Cl | HCl | 1,000 | 3.0 |
| Sb | $SbH_3$ | 500 | 3.0 |

Note:
*1Based on the volume of methane.

On two parts of the surface of the doped thin layer diamond, titanium, molybdenum and gold were deposited in this order to form ohmic electrodes. Further, by sputtering, $SiO_2$ was coated to form a protective layer on the semiconductive diamond. The produced thermistor had a cross section shown in FIG. 1, in which numeral 1 stands for a substrate, 2 stands for a semiconductive diamond thin layer, 3 stands for an ohmic electrode, 4 stands for a lead wire, and 5 stands of a protective layer.

Figure 2:
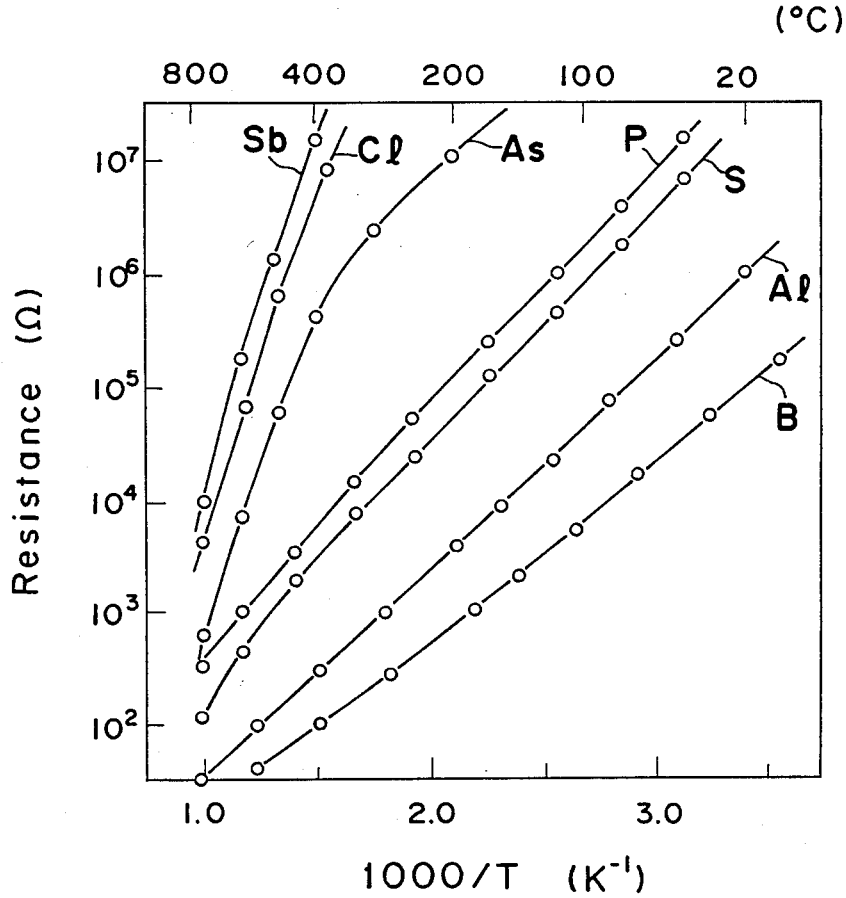
FIG. 2 is a graph showing the resistance-temperature characteristics of the thermistors produced in Example 1.

To the ohmic electrodes, two lead wires were connected, respectively, and the resistance-temperature characteristics were measured from room temperature to 800° C. The results are shown in FIG. 2.

When boron, aluminum, sulphur or phosphorus was doped in the thin layer diamond, the resistance of the thermistor linearly increases from room temperature to 800° C. Therefore, such thermistors are suitable or measuring temperatures in a wide temperature range of room temperature to 800° C.

When arsenic, chlorine or antimony was doped in the thin layer diamond, the thermistor keeps linearity in the resistance-temperature characteristics from 300° C. to 800° C. and has large change rate of the resistance against temperature. Therefore, such thermistor is suitable for measuring temperatures not lower than 300° C.

EXAMPLE 2

In the same manner as in Example 1 but changing a material of the electrode and forming or not forming the protective layer, a thermistor comprising thin layer diamond doped with boron was produced. In the formation of the electrode, layers of titanium, tantalum, molybdenum, aluminum, nickel and gold were formed by vacuum evaporation, layers of TiN, Tic and TaN were formed by reactive evaporation, and a layer of tungsten was formed by sputtering.

After keeping each thermistor at 750° C. for 500 hours, a change rate of resistance of the thermistor was measured. The results are shown in Table 2.

TABLE 2

| Run No. | Electrode Materials (from the first layer) | Protective layer | Change rate of resistance (%) |
|---|---|---|---|
| 1 | Ti, Mo, Au | $SiO_2$ sputter | 3 |
| 2 | Ti, Mo, Au | $Al_2O_3$ sputter | 2 |
| 3 | Ti, Mo, Au | $SiO_2$—$Al_2O_3$ glass | 3 |
| 4 | Ti, Mo, Au | None | 27 |
| 5 | TiN, Au | $SiO_2$ sputter | 6 |
| 6 | TiC, Au | $SiO_2$ sputter | 2 |
| 7 | Ta, Mo, Au | $SiO_2$ sputter | 4 |
| 8 | W, Au | $SiO_2$ sputter | 4 |
| 9 | Mo, Au | $SiO_2$ sputter | 3 |
| 10 | TaN, Au | $SiO_2$ sputter | 7 |
| 11 | Al, Mo, Au | $SiO_2$ sputter | 35 |
| 12 | Ni, Au | $SiO_2$ sputter | 20 |
| 13 | Silver paste calcined | None | 22 |

EXAMPLE 3

On a round substrate of 3 mm in diameter and 0.5 mm in thickness, a semiconductive diamond thin layer was grown by decomposing a raw material gas by heating a tungsten filament according to the method described in Japanese Journal of Applied Physics, 21 (1982) 183, the disclosure of which is hereby incorporated by reference.

The thin layer diamond was grown by supplying acetylene and hydrogen in a volume ratio of 1:50 and a doping compound as shown in Table 3 at a filament temperature of 2,300° C., a substrate temperature of 850° C. under pressure of 6 KPa for one hour.

On the thin layer diamond, tantalum, tungsten and gold were deposited in this order to form electrodes followed by attachment of lead wires. Then, a $SiO_2$ protective layer was formed by sputtering.

After keeping each thermistor at 750° C. for 500 hours, a change rate of resistance of the thermistor was measured. The results are shown in Table 3.

TABLE 3

| Run No. | Substrate | Dopant | Doping compound (ppm) | Change rate of resistance (%) |
|---|---|---|---|---|
| 1 | Si (polycrystal) | B | $B_2H_6$ (100) | 12 |
| 2 | Si (polycrystal) | S | $H_2S$ (500) | 7 |
| 3 | SiC (calcined) | B | $BCl_3$ (300) | 3 |
| 4 | $Si_3N_4$ (calcined) | P | $PH_3$ (500) | 3 |
| 5 | Ti | P | $PH_3$ (500) | 5 |
| 6 | TiC (calcined) | None | None | 3 |
| 7 | $Al_2O_3$ (calcined) | B | $B_2H_6$ (100) | 5 |
| 8 | AlN (calcined) | Se | $B_2H_6$ (100) | 5 |
| 9 | Mo | N | $NH_3$ (1,000) | 7 |
| 10 | W | None | None | 5 |
| 11 | Ta | Li | $Li(C_2H_5O)$ (−) | 5 |
| 12 | NbC (calcined) | N | $N_2$ (2,000) | 3 |
| 13 | Ni | B | $B_2H_6$ (100) | >30 |

Figure 3:
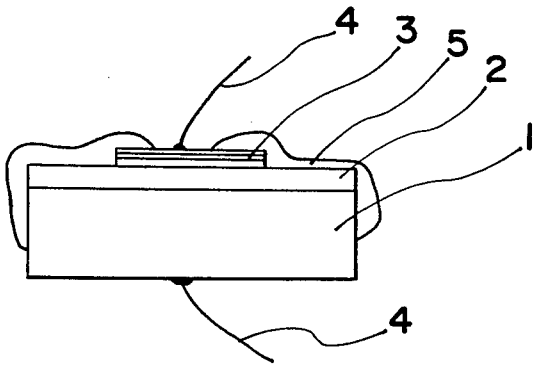
FIG. 3 is a cross section of another embodiment of a thermistor according to the present invention.

The thermistors produced in Run Nos. 3, 4, 7 and 8, had a cross section of FIG. 3, and others had a cross section of FIG. 1.

Figure 4:
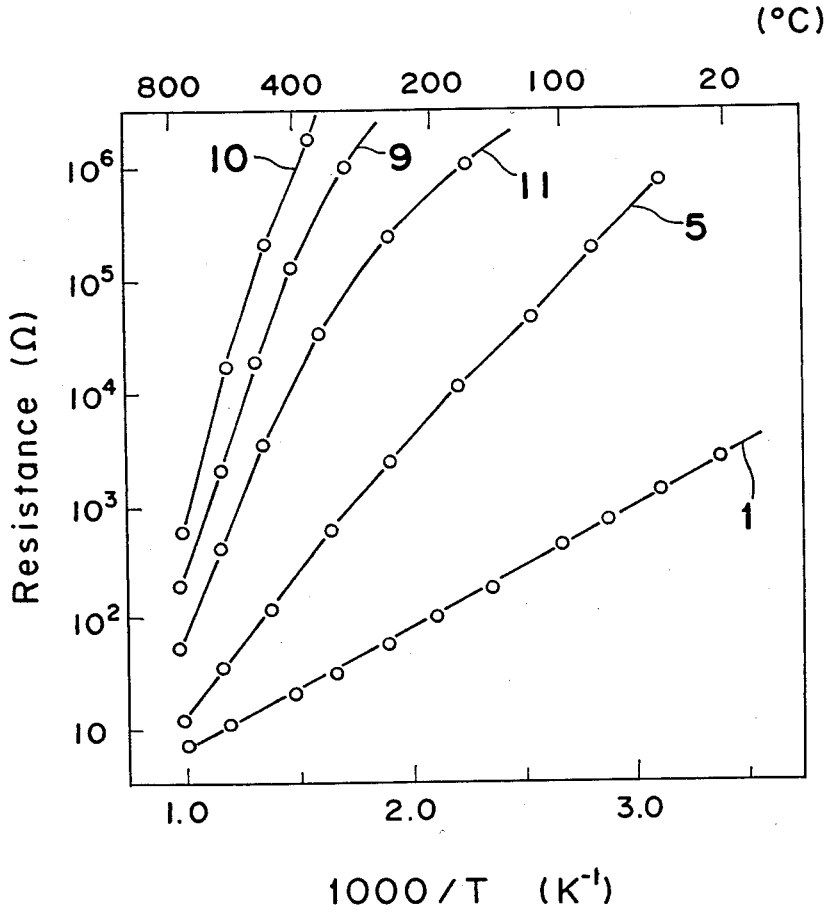
FIG. 4 is a graph showing the resistance-temperature characteristics of the thermistors produced in Example 3.

The resistance-temperature characteristics of the thermistors of Nos. 1, 5, 9, and 11 are shown in FIG. 4.

EXAMPLE 4

Figure 5:
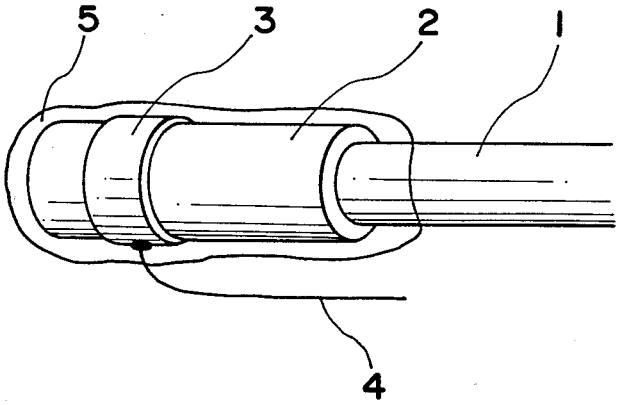
FIG. 5 is a cross section of further embodiment of a thermistor according to the present invention.

As shown in FIG. 5, one end portion of 1 of a molybdenum wire of 1.5 mm in diameter, a boron-doped diamond thin layer 2 was formed in the same manner as in Example 1 with supplying methane and diborane in a volume ratio of 2,000:1 in a growth time of one hour.

Figure 6:
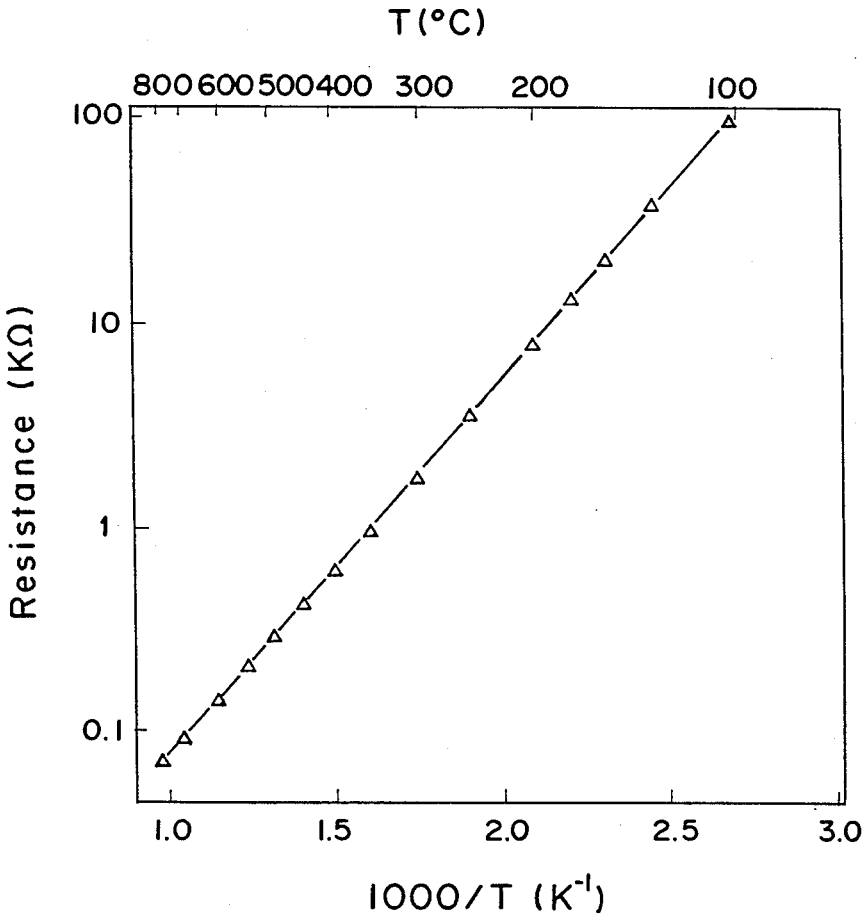
FIG. 6 is a graph showing the resistance-temperature characteristics of the thermistor produced in Example 4.

For forming an ohmic electrode 3, titanium and nickel were deposited in this order. Then, a lead wire 4 was connected to the ohmic electrode 3, and a $SiO_2$–$Al_2O_3$ glass protective layer 5 was formed. Its resistance-temperature characteristics is shown in FIG. 6.

What is claimed is:

1. A thermistor comprising a substrate and a heat sensitive element consisting of a thin film comprised of diamond deposited on said substrate.

2. The thermistor according to claim 1, wherein the diamond thin film is formed by a vapor phase synthetic method and has a thickness of 0.05 to 100 μm.

3. The thermistor according to claim 1, wherein the diamond thin film is a semiconductive diamond thin film containing a dopant.

4. The thermistor according to claim 3, wherein the dopant is at least one element selected from the group consisting of boron, aluminum, phosphorus, arsenic, antimony, silicon, lithium, sulfur, selenium, chlorine and nitrogen.

5. The thermistor according to claim 1, wherein the substrate is a single crystal diamond.

* * * * *